United States Patent [19]

Quaranti et al.

[11] Patent Number: 4,806,030

[45] Date of Patent: Feb. 21, 1989

[54] CORRECTION DEVICE FOR TYPEWRITERS

[75] Inventors: Giovanni Quaranti, Banchette; Claudio Gillio, Brosso; Gianpaolo Bonmassari, Ivrea, all of Italy

[73] Assignee: Ing. C. Olivetti & C., S.p.A., Ivrea, Italy

[21] Appl. No.: 132,254

[22] Filed: Dec. 14, 1987

[30] Foreign Application Priority Data

Jan. 29, 1987 [IT] Italy ..... 67055 A/87

[51] Int. Cl.[4] ..... B41J 1/30

[52] U.S. Cl. ..... 400/144.2; 400/697; 400/212

[58] Field of Search ..... 400/185, 187, 211, 212, 400/144.2, 144.3, 695, 697, 697.1

[56] References Cited

U.S. PATENT DOCUMENTS

| | | | |
|---|---|---|---|
| 4,239,400 | 12/1980 | Giolitti | 400/144.2 |
| 4,353,655 | 10/1982 | Watanabe et al. | 400/144.3 |
| 4,390,293 | 6/1983 | Gubau et al. | 400/144 |
| 4,472,073 | 9/1984 | Valle et al. | 400/185 |
| 4,605,324 | 8/1986 | Musso | 400/697 |

FOREIGN PATENT DOCUMENTS

| | | | |
|---|---|---|---|
| 2919209 | 11/1980 | Fed. Rep. of Germany | 400/144.2 |

*Primary Examiner*—David A. Wiecking

*Attorney, Agent, or Firm*—Banner, Birch, McKie & Beckett

[57] ABSTRACT

The correction device is applied to an electronic typewriter with a daisywheel and comprising an electric selector motor which selectively rotates the character-carrying daisywheel in the clockwise and the anti-clockwise directions for selecting the characters to be typed and/or corrected, a carrier for a correcting ribbon and a control member for lifting the carrier and permitting correction of the typed characters. A small correcting solenoid can be activated to couple the control member of the correcting ribbon to the selector motor. The control unit controls the motor and the solenoid in such a way that the selector motor can also actuate the control member in each correction cycle for positioning the correcting ribbon in front of the typing point. In the illustrated form, the solenoid unlatches a lever which drops to bring the control member into mesh with a gear on the motor shaft. The control gear is eccentrically mounted on the lever and a first 180° revolution, corresponding to 360° revolution of the daisywheel raises the lever and carrier to correcting ribbon height which a subsequent 180° rotation drops the carrier back to typing ribbon height with the lever latched by the solenoid armature.

18 Claims, 4 Drawing Sheets

CORRECTION DEVICE FOR TYPEWRITERS

BACKGROUND OF THE INVENTION

The present invention relates to a correction device for typewriters, in particular electronic typewriters.

In U.S. Pat. No. 4,462,707 a typing and correction device in electronic typewriters comprises a frame structure which is pivotally mounted on a movable carriage slidable parallel to the platen roller. A cartridge with a typing ribbon and two reels with a corresponding ribbon are mounted on the frame structure which is controlled by two solenoids, of which a first positions the typing ribbon in front of the platen roller and a second positions the correcting ribbon when a correction cycle is to be carried out. In that arrangement the correcting solenoid has to perform the operation of lifting and advancing the correcting ribbon. That solenoid is fairly large and therefore expensive. In addition, for actuation thereof, it requires an electronic power circuit which is also costly.

SUMMARY OF THE INVENTION

An object of the present invention is therefore to provide a correction device which is of very low cost and which at the same time is simple and reliable.

The object is achieved by the device according to the present invention which is characterised by a control member for lifting the carrier, a coupling means actuable for coupling the control member to the selector motor, and a control unit for causing actuation of the coupling means and producing activation of the selector motor such as to select the character to be cancelled in front of a typing point and to actuate the control member for positioning the carrier in an operative position in which the correcting ribbon is disposed in front of the typing point.

BRIEF DESCRIPTION OF THE DRAWING

A preferred embodiment of the invention is set forth in the following description which is given by way of non-limiting example with reference to the accompanying drawing in which.

Figure 5:
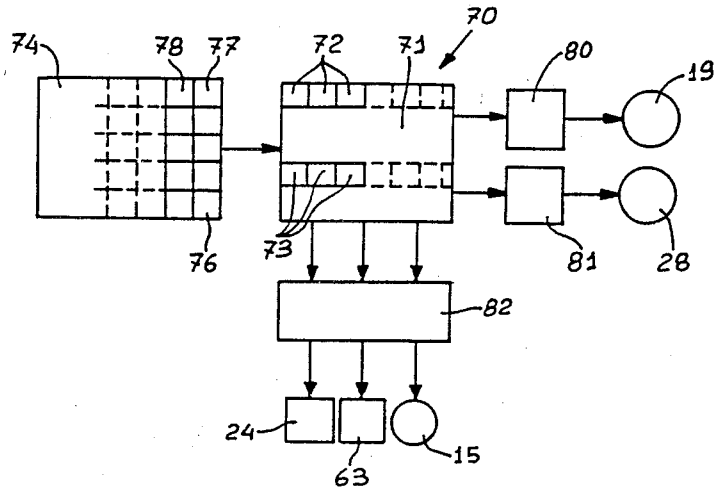
FIG. 5 shows a block logic diagram of a control and actuating unit of the machine in FIG. 1.

In the embodiment described hereinafter, the correction device 12 (see FIGS. 1, 2 and 5) is applied by way of example to a portable electronic typewriter comprising a conventional platen roller 13 which is rotated by an electric motor 15, a sheet of paper 14 on which the typing and correction point is indicated by 16, and a carriage 17.

The carriage 17 is slidable transversely with respect to the platen roller 13 along a guide 18 parallel to the roller 13. The carriage 17 is displaced in the two directions for example by means of a reversible electric stepping motor 19 substantially similar to that described in U.S. Pat. No. 3,707,214. The carriage 17 (FIGS. 1 and 2) is formed by two side members 20 and 21 which are fixed with respect to each other. The carriage 17 comprises a spindle 22 on which a frame structure 23 is pivotally mounted, and means which are arranged, in known manner (not shown) to fix a striker solenoid 24 having a striker member 26 for co-operating with a character-carrying disc indicated generally at 27, and an electric motor 28, for example of the reversible stepping type. The character-carrying disc or daisywheel 27 is fixed in known manner to a selector shaft 29 which can be rotated by the motor 28. The disc 27 comprises a peripheral notched ring which provides for the flexible blades 31 and in which each blade 31 carries a corresponding typing character 32, at one end. The typing characters 32 are selected by means of the motor 28 in known manner, for example as described in U.S. Pat. No. 3,983,985.

The frame structure 23 supports cartridge 33 with typing ribbon 34 and by means of an arm 36, two reels 37 on which a correcting or cancellation ribbon 38 is wound (only one reel 37 can be seen in the drawing). Each reel 37 is fixed with respect to a toothed wheel 39 which is rotatable on a shaft 41 on the arm 36. The correcting ribbon 38 is advanced in known manner, for example as described in U.S. Pat. No. 4,462,707. The correcting ribbon 38 is guided in the vicinity of the platen roller 13 by two ribbon guide rollers 42 which are rotatable on shafts 43 on the arm 36. A single ribbon guide roller 42 can be seen in the drawing.

Figure 1:
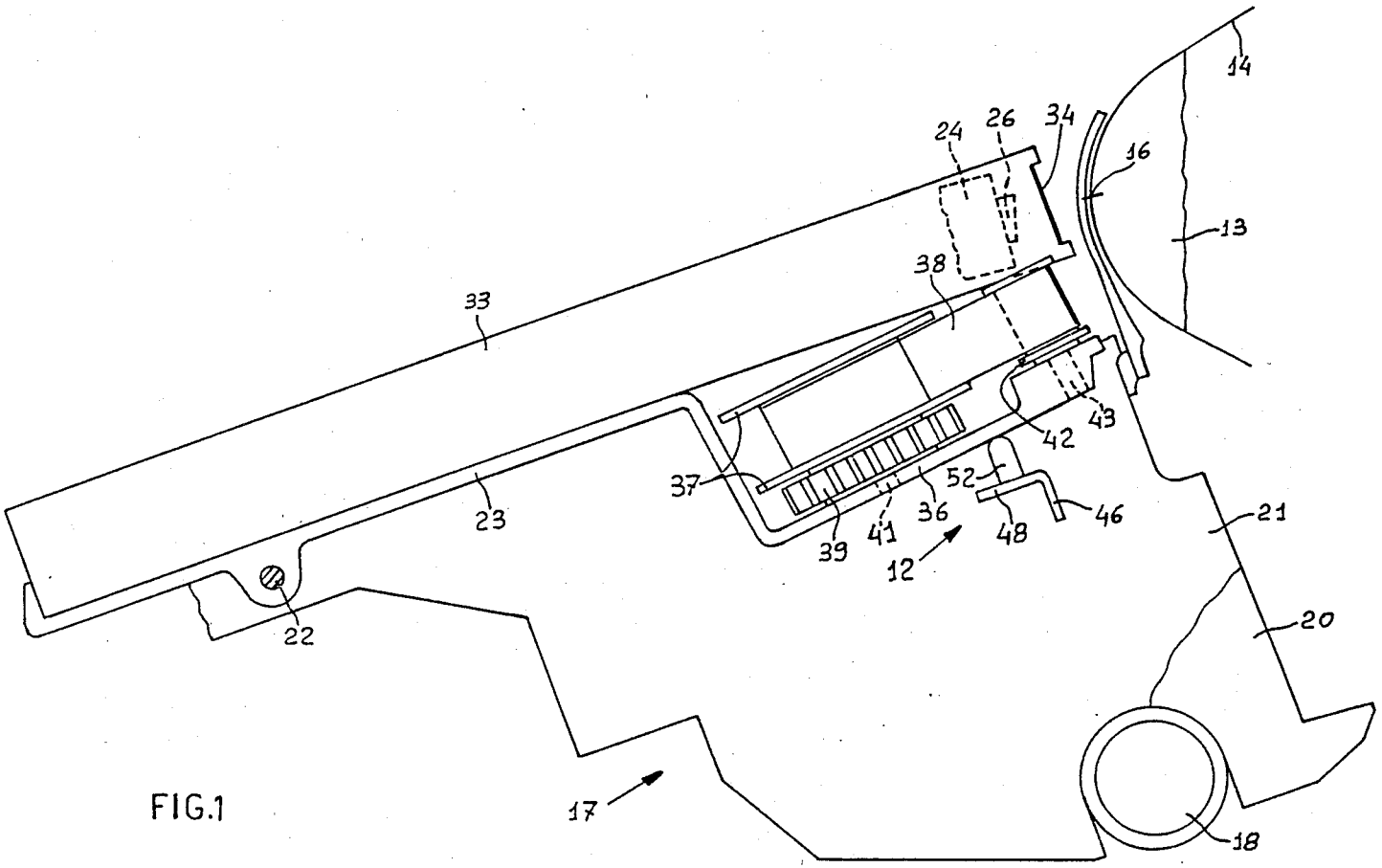
FIG. 1 is a longitudinal view of part of a typewriter having the device according to the invention.
Figure 4:
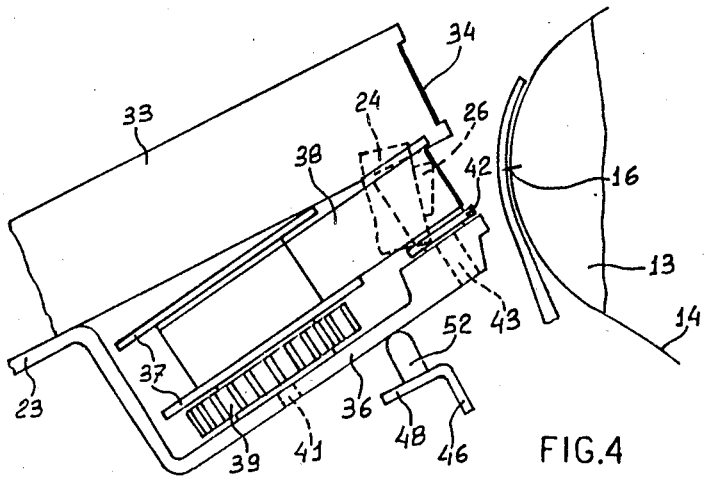
FIG. 4 is a partial view of some details from FIG. 1 in the operating position of the device as shown in FIG. 3.

The frame structure 23 is movable from the rest position shown in FIG. 1 in which the typing ribbon 34 is disposed in front of the typing point 16 but permits the whole of the line of typing passing through the typing point 16 to be viewed, to a correction or operating position as shown in FIG. 4 in which the correcting ribbon 38 is positioned in front of the typing point 16.

Figure 2:
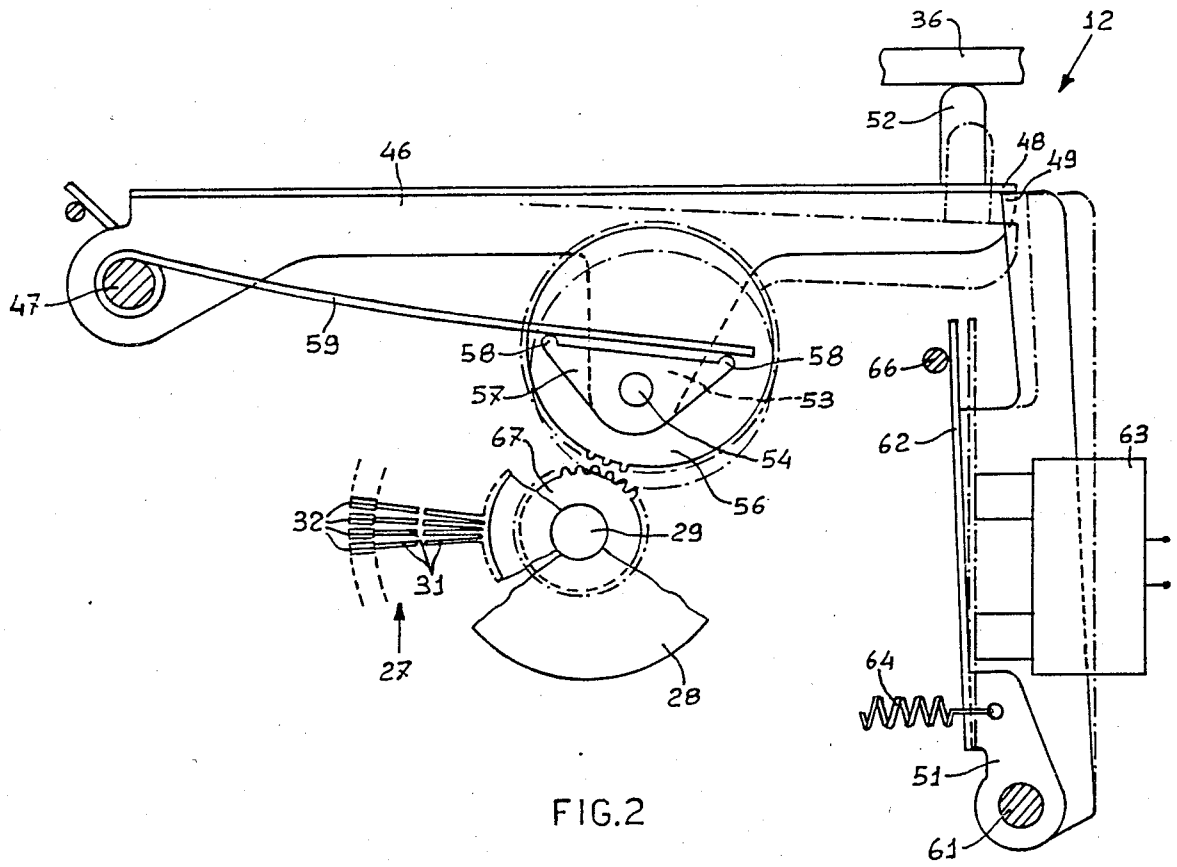
FIG. 2 is a view of part of the device in FIG. 1 on an enlarged scale.

The device 12 (see FIGS. 2 and 3) comprises a control member or lever 46 which is pivotally mounted on a fixed shaft 47 having one end 48 capable of co-operating with a shoulder 49 on a stop element or armature lever 51. The end 48 has a pin 52 co-operable with the arm 36 of the structure 23. The control lever 46 has a limb portion 53 with a pin 54 on which is mounted a cyclic actuating mechanism comprising an eccentric, toothed wheel 56 rotatable on the pin 54 and fixed in one piece with a rest position setting element 57 having two shoulders 58 of cylindrical shape co-operable with a positioning spring 59. The lever 51 is pivotally mounted on a fixed shaft 61 and comprises a blade portion 52 co-operable with a correcting solenoid 63. A spring 64 normally holds the lever 51 rotated in an anti-clockwise direction in a condition of boaring with the blade portion 62 against a fixed stop 66. The eccentric toothed wheel 56 can mesh with a connecting element or drive toothed wheel comprising a pinion 67 fixed to and rotatable with the selector shaft 29 by the force of the positioning spring 59 in an operating phase wherein a connecting cycle is performed as described hereinafter. In the rest position of the setting element 57, as shown in FIG. 2, the positioning spring 59 engages with the two cylindrical shoulders 58. During the correcting cycle, as more clearly described hereinafter, the eccentric wheel 56 is rotated with the setting element 57 by the pinion 67 from the rest position to the operating position.

While the correcting cycle is performed, the positioning spring 59 engages only one of the two cylindrical shoulders 58, acts on the one shoulder 58 for moving and positioning the rest position setting element 57 with the eccentric wheel 56 in the rest position. The transmission ratio between the pinion 67 and the eccentric toothed wheel 56 is 2 to 1, whereby a rotary movement through 180° of the eccentric toothed wheel 56 corresponds to a rotary movement through 360° of the selector shaft 29.

The device 12 as described hereinbefore is applied to an electronic typewriter, as already described above, comprising an individual microprocessor 70 (see FIG. 5), for example of the type 6301Y, provided with a central unit 71, a series of memories 72, and a series of counters 73, and is connected to a keyboard 74. The central unit 71 controls and governs the clockwise and anti-clockwise rotary movements and the stoppages of the motors 19 and 28 and the excitation times of the solenoids 24 and 63. The solenoid 63 is of limited consumption (about 4 watts peak) and the microprocessor 70 controls the solenoids 24 and 63 and the motor 15 by means of a single integrated circuit 82 and the motors 19 and 28 by means of two control units formed by two per se known integrated circuits 80 and 81.

The mode of operation of the device 12 is as follows:

As already described above, the structure 23 (see FIG. 1) is in the position shown in FIG. 1 in which the cartridge 33 has the typing ribbon 34 in front of the typing point 16 and the device 12 is in the position shown in solid lines in FIG. 2, that is to say with the control lever 46 arrested by the shoulder 49 and thus with the eccentric toothed wheel 56 disengaged from the pinion 67. The operator depresses the various keys of the keyboard 74 (see FIG. 5) and the central unit 71 controls the rotary movements and the stoppages of the motors 19 and 28 and energisation of the striker solenoid 24, and thus types on the sheet of paper 14. For enhanced clarification and simplification and thus to clearly demonstrate the simplicity of the device 12, some non-limiting examples, in accordance with the invention, will be described.

Let us suppose that the operator wishes to type the word n'BANCA' but instead has typed 'BANCE'. The carriage 17 is positioned a certain number of elementary steps after the last character typed, depending on the type of daisywheel 27 used by the operator. In the example in question, if the operator notices the mistake immediately after having hit the letter 'E', it is only necessary to depress the correction key 76 on the keyboard 74. In that case the central unit 71 activates the motor 19 to return the carriage 17 by one step and at the same time predisposes the arrangement to select the last letter typed, namely the 'E'. The central unit 71 now causes energisation of the correcting solenoid 63 which rotates the armature lever 51 in the clockwise direction against the force of the spring 64. The shoulder 49 frees the end 48 and the armature lever 51 is positioned in the position shown in dash-dotted lines in FIG. 2. At the same time the positioning spring 59 rotates the control lever 46 in the clockwise direction, causing the eccentric toothed wheel 56 to mesh with the pinion 67 as shown in dash-dotted lines in FIG. 2.

Figure 3:
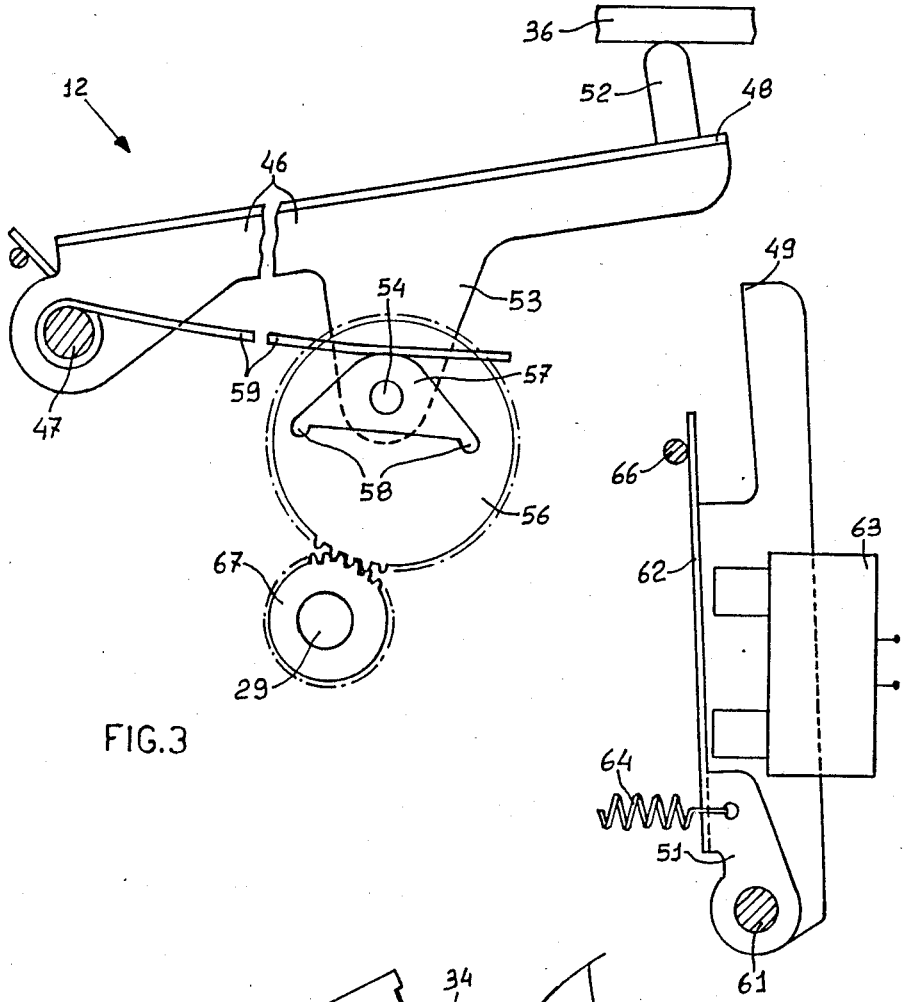
FIG. 3 is a view of part of the device shown in FIG. 2 in an operating position.

The central unit 71 now activates the motor 28 for a cycle of rotary movement through 360° of the selector shaft 29, the daisywheel pinion 27 and the 67. The pinion 67 being meshed with the eccentric toothed wheel 56, it rotates it but, as the transmission ratio is 1 to 2, as stated above, the eccentric toothed wheel 56 rotates through 180°, and, by virtue of its eccentricity, rotates the control lever 46 in the anti-clockwise direction against the force of the positioning spring 59, lifting the control lever 46 as shown in FIG. 3. The control lever 46 in turn, by way of the pin 52 engaged with the arm 36, causes the structure 23 to be rotated in an anti-clockwise direction and thus positions the correcting ribbon 38 in front of the typing point 16, as shown in FIG. 4.

The control unit 71 now causes energisation of the striker solenoid 24: the striker member 26 engages the character 32 which is positioned in front of the typing point 16, that is to say in the example in question, the letter 'E', and causes it to strike against the roller 13. Since the correcting ribbon 38 is in front of the typing point 16, the previously typed letter 'E' is removed from the paper 14. In the meantime the central unit 71 has deenergised the correcting solenoid 63 and the spring 64 has returned the armature level 51 to its rest condition of bearing against the fixed stop 66. The central unit 71 now again activates the motor 28 but in the opposite direction to the previous direction for a cycle of rotary movement through 360° of the selector shaft 29, the daisywheel 27 and the pinion 67. The pinion 67 is still engaged with the eccentric toothed wheel 56 due to the force of the positioning spring 59, and rotates it in the opposite direction to the previous rotary movement whereby the control lever 46 rotates in a clockwise direction, moving downwardly, until the end 48 is engaged with the shoulder 49 and is arrested in the position shown in solid lines in FIG. 2. The eccentric wheel 56 is disengaged from the pinion 67. The spring 59 in turn moves the wheel 56 into the rest condition, being engaged with the higher of the two cylindrical shoulders 58 on the element 57 until the other shoulder is at the same height as the first. The motor 28 and the selector shaft 29 with the daisywheel 27 and the pinion 67 are stopped after the 360° cycle.

The operator can now depress the key of the keyboard 74 corresponding to the letter 'A'. The central unit 71 activates a typing cycle in which the letter 'A' is struck, the carriage 17 is positioned one step after the word 'BANCA' and the operator can thus continue typing the text.

Let us suppose as a second example that the operator still wishes to type the word 'BANCA' but instead has typed 'BINCA'. The carriage 17 is positioned one or more steps after the last character typed, depending on the type of daisywheel 27 used by the operator of the machine, in the example in question being after the letter 'A'. The operator now notices the mistake and thus depresses the back space key 77 as many times as the number of characters already typed, being four spaces in the example in question. The central unit 71, by way of the motor 19, returns the carriage 17 by a distance of four steps. The operator now depresses the correcting key 76 and the central unit 71, by means of the memories 72 and the counters 73, activates the motor 24 to select the incorrect character, being the letter 'I' in the example in question. After that the central unit 71 causes energisation of the correcting solenoid 63 and the charactercarrying daisywheel 27 performs a first rotary movement through 360°, with repetition of the procedure described in the first example until the faulty letter, that is to say, the 'I' is cancelled, with a second rotary movement of the daisywheel 27 through 360° and return of the correcting ribbon 38 to the rest position.

The user or operator now has the daisywheel 27 positioned in front of the corrected typing point 16 in the typed word 'B NCA'; the operator at that point depresses the key of the keyboard 74 corresponding to the letter 'A'. The central unit 71 now produces the typing cycle, causes the letter 'A' to be struck and moves the carriage 17 to the letter 'N'. The operator now operates the carriage feed key 78 of the keyboard 74 and the central unit 71 causes forward feed movement of the carriage 17 by as many steps as the number of times that the key 78 is depressed until reaching the position required by the operator, thereby to resume typing.

The central unit 71 is also capable of controlling automatic cancellation of words typed in previous lines and the current line, in per se known manner. In that case the device according to the invention also operates in a similar manner to that described above.

It will be apparent that the device 12 according to the invention is very simple and reliable and very low in cost, in fact, selection of the typing ribbon 34 or the correcting ribbon 38 being controlled by making use of the clockwise and anticlockwise rotary movements of the motor 28 which selects the character 32 to be typed. In addition it will be appreciated that the above-described examples do not constitute a limitation on the invention but are set forth in order better to show the simplicity and ease of use of the device 12 according to the invention. The services to be performed by the electronic typewriter with the device 12 described above by means of the various examples depend on the capacity of the central unit 71 which, depending on the amount of memories 72 and counters 73 can store and subsequently cancel or correct the entire last line or plurality of lines.

It will be appreciated that the above-described device 12 may be the subject of various modifications, improvements and addition of parts without departing from the scope of the invention.

In a first alternative embodiment, the transmission ratio between the pinion 67 and the toothed wheel 56 is unity. In that case, in the initial phase of the correcting cycle, the arrangement selects a character on the daisywheel 27 which is at 180° with respect to the character of the selection. The other correcting phases take place as described above, with the difference that the two rotary movements of the shaft 29 for lifting the correcting ribbon 38 and returning it to the rest position are both through 180° instead of 360°.

In a second alternative form the lever 51 is provided with a second shoulder which is capable of holding the lever 46 in the raised position when the solenoid 63 is energised. In that case, after a rotary movement through 180°, the pinion 67 and the wheel 56 move the lever 46 with an extra travel upwards and are subsequently disengaged when the lever 46 is held by the second shoulder on the lever 51. The element 57 which is suitably modified provides for positioning in the rest position the wheel 56. The ribbon 38 then returns to the rest condition after de-energisation of the solenoid 63 under the control of the spring 59 without the need for a further rotary movement of the shaft 29.

Figure 6:
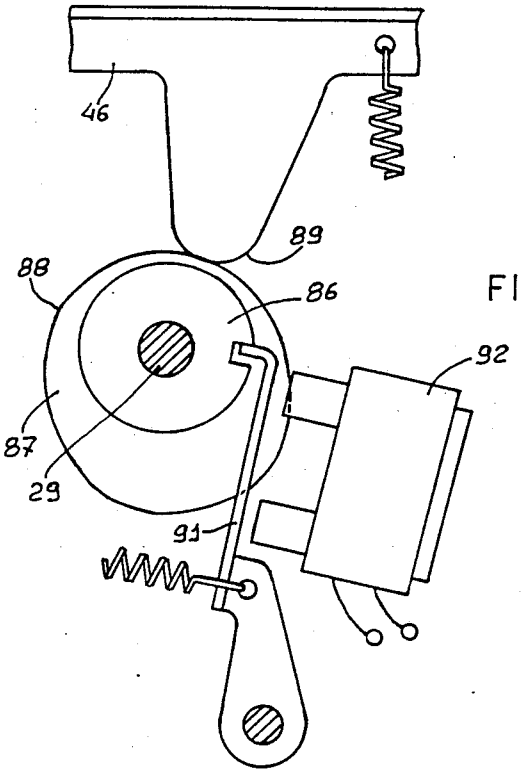
FIG. 6 shows an alternative form of the device shown in FIG. 2.

In a third alternative form, instead of the toothed wheel 56, the arrangement uses a cam member which operates in a similar manner to the toothed wheel 56. In that construction, the assemblies comprising the pinion 67, the toothed wheel 56, the spring 59, the blade 62 and the solenoid 63 are replaced by a spring-type clutch as diagrammatically indicated at 86 (see FIG. 6) of which the driven component is keyed on the shaft 29 and a driven component 87 is provided with an eccentric profile 88 engaged by a cam follower 89 of the control lever 46. The clutch 86 is controlled by the armature 91 of a solenoid 92 similar to the solenoid 63. During the typing phases, the clutch 86 is normally opened and the profile 88 presents the lowest height thereof to the cam follower 89. In the initial phase of a correcting cycle, the microprocessor 70 selects, in front of the correcting point, a character on the daisywheel 27 which is disposed at 180° with respect to the character to be corrected. Then, the solenoid 92 is activated to close the clutch 86 and the motor 28 is activated for a rotary cycle through 180° of the shaft 29 which on the one hand positions the character to be corrected in front of the correcting point and on the other hand raises the lever 46 by means of the profile 88. The correcting cycle takes place as in the above-described cases. After correction of the character, the microprocessor 70 again activates the motor 28 for a further rotary movement of 180° of the daisywheel 27 and the profile 88. The control lever 46 is returned to the rest position while the clutch 86 is re-opened by the armature 91 at the end of the cycle.

What we claim is:

1. A correction device for typewriters comprising a platen roller which defines a typing point, a correcting ribbon, a rotatable character-carrying member, a carrier for the correcting ribbon which can be lifted to permit correction of characters, a selector motor for selectively rotating the character-carrying member in the clockwise and counterclockwise directions for selecting the characters to be typed and corrected, a control member for lifting the carrier, a coupling means actuatable for coupling the control member to the selector motor, and a control unit for causing actuation of the coupling means and producing activation of the selector motor such as to select the character to be cancelled in front of the typing point and to actuate the control member for positioning the carrier in an operative position in which the correcting ribbon is disposed in front of the typing point, wherein the motor comprises a selector shaft and the character-carrying member is of the type having flexible blades and is fixed on the selector shaft, and a connecting element of the selector shaft cooperates selectively with the control member in response to the actuation of the coupling means to move the carrier to its operative position in response to a predetermined rotary movement of the selector shaft.

2. A device according to claim 1, comprising a toothed drive wheel synchronous with the character-carrying member, wherein the control member comprises an oscillating lever operative on the carrier, an eccentric, rotatable, driven, toothed wheel on the oscillating lever, a spring element urging the oscillating lever to bring the eccentric toothed wheel into engagement with the drive toothed wheel in a predetermined phase, and wherein the coupling means normally holds the eccentric toothed wheel uncoupled from the drive toothed wheel against the force of the spring element.

3. A device according to claim 2, wherein the coupling means comprises a stop element for holding the oscillating lever in the uncoupled position, and a solenoid actuable for moving the stop element and freeing the oscillating lever to enable the spring element to bring the eccentric toothed wheel into engagement with the drive toothed wheel.

4. A device according to claim 3, wherein the carrier comprises two ribbon guide rollers which are rotatable on an arm of the carrier to guide the correcting ribbon in front of the character-carrying member and in which the oscillating lever has a pin co-operable with the arm of the carrier for positioning the correcting ribbon in front of the typing point.

5. A device according to claim 4, further comprising a rest position setting element fixed in one place with the eccentric toothed wheel.

6. A device according to claim 5, wherein the rest position setting element comprises two cylindrical shoulders and wherein the spring element is cooperable with the two cylindrical shoulders.

7. A device according to claim 6, wherein an electronic control unit controls and actuates the clockwise and anti-clockwise rotary movements of the selector motor and actuation of the coupling means.

8. A device according to claim 7, wherein after cancellation of the character, the control unit produces further activation of the selector motor to return the control member to its rest position.

9. A device according to claim 8, wherein the electronic control unit actuates the solenoid which rotates the stop element, freeing the oscillating lever, and wherein the spring element rotates the oscillating lever and causes engagement of the eccentric toothed wheel with the drive toothed wheel.

10. A device according to claim 9, wherein the transmission ratio between the drive toothed wheel and the eccentric toothed wheel is 2 to 1 and wherein the control unit produces rotary movement through 360° of the shaft of the selector motor for a rotary movement through 180° of the eccentric toothed wheel such as to position the control lever in the operative position.

11. A device according to claim 10, wherein the control unit, after a correcting cycle, produces rotary movement through 360° of the shaft of the selector motor but in the opposite direction to disengage the eccentric toothed wheel from the drive toothed wheel.

12. A device according to claim 11, further comprising a cartridge, a typing ribbon disposed in the cartridge removably fixed on the carrier, wherein the typing ribbon is disposed in front of the typing point, and wherein during the correcting cycle the oscillating lever through the pin moves the carrier for positioning the correcting ribbon in front of the typing point.

13. A typing and cancelling device for electronic typewriters comprising a platen roller having a line of typing which defines a typing point, and oscillating carrier, a typing ribbon, a correcting ribbon, a carriage movable in two directions parallel to the platen roller, wherein mounted on said carriage are the oscillating carrier having thereon the typing ribbon and the correcting ribbon, a control member for lifting the carrier and permitting correction of characters, a character-carrying member and a first electric motor for selectively rotating the character-carrying member in the clockwise and counterclockwise directions, for selecting the characters to be typed and to be corrected, a second electric motor for positioning the carrier along the line of typing, a striker solenoid for causing the selected characters to strike against the roller, an electronic controlled unit having a series of memories and counters for controlling the motors and the striker solenoid, a second solenoid operable for actuating a stop lever to free the control member for engaging a toothed element of the control member with a toothed wheel on the shaft of the first motor and wherein the first motor actuates the control member for positioning the carrier in such a way as to bring the correcting ribbon in front of the typing point and thereby for starting a correcting cycle for the character to be corrected.

14. A device according to claim 13, wherein a keyboard is connected to the control unit and comprises a series of keys capable of positioning the carriage from an initial position to any position along the line of typing, actuating single or repeated correction cycles and repositioning the carriage in the initial position.

15. A correcting device for typewriters comprising a platen roller which defines a typing point, a correcting ribbon, a rotatable character-carrying member, a carrier for the correcting ribbon which can be lifted to permit correction of characters, a selector motor having a selector shaft operatively connected with the character carrying member for rotating the character-carrying member in the clockwise and counterclockwise directions for selecting the charcters to be typed and corrected, a control member for lifting the carrier, a connecting element permanently driven by the selector shaft, a coupling means actuable for coupling the control member to the connecting element and a control unit for causing actuation of the coupling means and producing activation of the selector motor for predetermined rotation such as to actuate the connecting element and the control member for positioning the carrier in an operative position in which the correcting ribbon is disposed in front of the typing point for a variable rotation such as to select the carrier to be cancelled in front of the typing point.

16. A device according to claim 15, wherein the connecting element comprises a toothed drive wheel synchronous with the character-carrying member, wherein the control member comprises an oscillating lever operative on the carrier, an eccentric, rotatable, driven, toothed wheel on the oscillating lever, a spring element urging the oscillating lever to bring the eccentric toothed wheel into engagement with the toothed drive wheel in a predetermined phase, and wherein the coupling means normally holds the eccentric toothed wheel uncoupled from the toothed drive wheel against the force of the spring element.

17. A device according to claim 16, wherein the coupling means comprises a stop element for holding the oscillating lever in the uncoupled position, and a solenoid actuatable for moving the stop element and freeing the oscillating lever to enable the spring element to bring the eccentric toothed wheel into engagement with the toothed drive wheel.

18. A method of cancelling characters typed by means of an electronic typewriter comprising a rotatable character-carrying member, a selector motor having a selector shaft on which is fixed the character-carrying member, a correcting ribbon which can be raised from a rest position to an operative position in front of a typing point and a lifting member connected to the correcting ribbon and operable to rotate through an operative angular distance for movement of the correcting ribbon from the rest position to the operative position, having the following steps:

(a) selecting in front of the typing point a charcter of the character-carrying member which is disposed a predetermined angular spacing with respect to the character to be used for the correction operation;

(b) activating a coupling means for coupling the selector shaft to the lifting member for lifting the correction ribbon;

(c) actuating the selector motor for a rotary movement to rotate the character-carrying member through its predetermined angular spacing and the lifting member through its operative angular distance;

(d) cancelling the typed character by striking of the character to be used for the correction operation; and (e) providing for de-activation of the coupling means and return to the rest condition of the lifting member with the correcting ribbon.

* * * * *